US006880583B2

(12) United States Patent
Billings

(10) Patent No.: US 6,880,583 B2
(45) Date of Patent: Apr. 19, 2005

(54) PAPERMAKER'S AND INDUSTRIAL FABRIC SEAM

(75) Inventor: Alan L. Billings, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 298 days.

(21) Appl. No.: 10/159,926

(22) Filed: May 29, 2002

(65) Prior Publication Data

US 2003/0221739 A1 Dec. 4, 2003

(51) Int. Cl.[7] ..... D21F 11/04

(52) U.S. Cl. ..... 139/383 AA; 139/383 A; 162/132; 162/133; 162/203; 162/904

(58) Field of Search ..... 139/383 A, 383 AA; 162/132, 133, 203, 904

(56) References Cited

U.S. PATENT DOCUMENTS

| | | | | | |
|---|---|---|---|---|---|
| 4,244,084 | A | * | 1/1981 | Gisbourne | 24/33 C |
| 4,344,209 | A | * | 8/1982 | Harwood | 24/31 R |
| 4,427,734 | A | | 1/1984 | Johnson | |
| 4,574,435 | A | * | 3/1986 | Luciano et al. | 24/33 C |
| 4,806,208 | A | * | 2/1989 | Penven | 162/199 |
| 4,827,579 | A | * | 5/1989 | Gisbourne | 24/391 |
| 4,839,213 | A | * | 6/1989 | Gauthier | 428/114 |
| 4,862,926 | A | * | 9/1989 | Barrette et al. | 139/383 AA |
| 4,896,702 | A | * | 1/1990 | Crook | 139/383 A |
| 5,217,415 | A | | 6/1993 | Wasylezuck et al. | |
| 5,360,656 | A | | 11/1994 | Rexfelt et al. | |
| 5,377,722 | A | * | 1/1995 | Jaala | 139/383 AA |
| 5,488,976 | A | * | 2/1996 | Lorenz et al. | 139/383 AA |
| 5,503,196 | A | | 4/1996 | Josef et al. | |
| 5,514,456 | A | * | 5/1996 | Lefferts | 428/222 |
| 5,720,323 | A | * | 2/1998 | Tremer | 139/446 |
| 5,746,257 | A | * | 5/1998 | Fry | 139/383 AA |
| 5,769,131 | A | | 6/1998 | Whitlock et al. | |
| 5,875,822 | A | * | 3/1999 | Fargeout | 139/383 AA |
| 5,915,422 | A | * | 6/1999 | Fagerholm | 139/383 AA |
| 6,001,443 | A | * | 12/1999 | Holden et al. | 428/61 |
| 6,065,505 | A | * | 5/2000 | Fickers | 139/383 AA |
| 6,105,625 | A | | 8/2000 | Shimono | 139/384 B |
| 6,241,081 | B1 | * | 6/2001 | Holden | 198/844.2 |
| 6,265,048 | B1 | * | 7/2001 | Rydin et al. | 428/121 |
| 6,305,027 | B1 | * | 10/2001 | Chou | 2/227 |
| 6,328,079 | B1 | * | 12/2001 | Zils | 139/383 AA |
| 6,451,412 | B1 | * | 9/2002 | Holden | 428/193 |
| 6,544,389 | B1 | * | 4/2003 | Johnson | 162/348 |

FOREIGN PATENT DOCUMENTS

| | | |
|---|---|---|
| DE | 21 02 478 A | 10/1972 |
| EP | 0 564 436 A | 10/1993 |
| FR | 2 145 365 A | 2/1973 |

OTHER PUBLICATIONS

International Search Report prepared by European Patent Office for corresponding international application No. PCT/US03/12857 and mailed Sep. 23, 2003.

* cited by examiner

*Primary Examiner*—John J. Calvert
*Assistant Examiner*—Robert H. Muromoto, Jr.
(74) *Attorney, Agent, or Firm*—Frommer Lawrence & Haug LLP; Ronald R. Santucci

(57) ABSTRACT

A papermaking or other industrial fabric formed from a base fabric and having a seam where a first end of the base fabric is attached to a second end of the base fabric. At least one preformed coil is used to attach the first end of the base fabric to the second end.

22 Claims, 5 Drawing Sheets

PAPERMAKER'S AND INDUSTRIAL FABRIC SEAM

BACKGROUND OF THE INVENTION

1. Field of the Invention

The present invention relates primarily to the papermaking arts. Specifically, the present invention relates to seamable fabrics for use on papermaking machines, in addition to other industrial applications. More specifically, the present invention relates to seamable fabrics used as industrial process fabrics in the production of, among other things, wet laid products such as paper, paper board, and sanitary tissue and towel products; in the production of wet laid and dry laid pulp; in processes related to papermaking such as those using sludge filters, and chemiwashers; in the production of tissue and towel products made by through-air drying processes; and in the production of non-wovens produced by hydroentangling (wet process), melt blowing, spunbonding, and air laid needle punching. Such industrial process fabrics include but are not limited to non-woven felts; embossing, conveying, and support fabrics used in processes for producing non-wovens; filtration fabrics and filtration cloths. The term "industrial process fabrics" also includes but is not limited to all other paper machine fabrics (forming, pressing and dryer fabrics) for transporting the pulp slurry through all stages of the papermaking process. In particular, the present invention is related to fabrics of the variety that may be used to mold cellulosic fibrous web into a three-dimensional structure.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process, which proceeds at considerable speeds. That is to say, the fibrous slurry is continuously deposited onto the forming fabric in the forming section, while a newly manufactured paper sheet is continuously wound onto rolls after it exits from the dryer section.

Contemporary fabrics are produced in a wide variety of styles designed to meet the requirements of the paper machines on which they are installed for the paper grades being manufactured. Generally, they comprise a woven base fabric which, depending upon the application may include needled batt of fine, non-woven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise ends of the base fabric are provided with seaming loops using the machine-direction (MD) yarns thereof. In this process, the MD yarns weave continuously back-and-forth between the widthwise ends of the fabric, at each end turning back and forming a seaming loop. A base fabric produced in this fashion is placed into endless form during installation on a papermachine, and for this reason is referred to as an on-machine-seamable (OMS®) fabric. To place such a fabric into endless form, the two widthwise ends are brought together, the seaming loops at the two ends are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics or by using resin(s) to join them to one another. One or both woven base fabrics may be of the on-machine-seamable type.

U.S. Pat. No. 5,769,131 shows an on-machine-seamable papermaker's fabric that includes flat machine-direction yarns which define the upper and lower surfaces of the fabric. The fabric has two layers of cross-machine-direction yarns, each of which is interwoven with the flat machine direction yarns. Other machine-direction yarns, of round cross section, weave with the cross-machine-direction yarns in the two layers to bind the two layers together. The fabric is seamed into endless form during installation on a paper machine. At one of the two ends of the fabric, seaming loops are formed by the flat machine-direction yarns. The seaming loops are interdigitated with one another when the two ends of the fabric are brought together during installation on the paper machine, defining a passage through which a seaming pin or pintle may be directed to join the two ends to one another.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers. Needless to say, this requirement makes it difficult to streamline the manufacturing process, as each fabric must typically be made to order.

In response to this need to produce fabrics in a variety of lengths and widths more quickly and efficiently, press fabrics have been produced in recent years using a spiral technique disclosed in commonly assigned U.S. Pat. No. 5,360,656 to Rexfelt et al., the disclosure of which is incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal end portions of adjoining spiral turns may be arranged overlappingly, so long as the ends have a reduced thickness, so as not to give rise to an increased thickness in the area of the overlap. Further, the spacing between lengthwise yarns may be increased at the ends of the strip, so that, when adjoining spiral turns are arranged overlappingly, there may be an unchanged spacing between lengthwise threads in the area of the overlap.

In the case of dryer fabrics, in particular, such fabrics were produced by flat weaving and then joined together. Dryer fabrics that are used today are too long and require a seam for installation, since dryer section frames are solid without contilever components and thus prevent the use of endless woven fabrics. Accordingly, the fabrics must be installed with a seam, since they cannot be put on endless.

It should be noted that contemporary fabrics also include fabrics with non-woven bases. An example of a non-woven fabric is shown in U.S. Pat. No. 4,427,743, which discloses a wet press felt for use on papermaking machines. The wet press felt includes a conventional felt fabric and a multiple of non-woven layers of synthetic textile fibers needled to the felt. Interposed between the layers of synthetic textile fiber are mesh fabrics which support the individual non-woven layers and retard compaction of the overall construction. Such non-woven fabrics may be provided with seams like those of the woven fabrics in order to realize an "endless" non-woven fabric.

In addition to the aforenoted modified endless weaving which provides a seamable fabric, there exists other types of seams heretofore utilized, particularly in the case of dryer fabrics. For example, some flat woven dryer fabrics had clipper hook seams as are used in corrugator belts today. However, clipper hooks tend to corrode. More importantly, clipper hooks wear, do not flex well (they tend to bump around fabric support rolls), and the seam tends to mark the paper sheet.

Some fabrics are seamed on a diagonal in a manner as set forth in U.S. Pat. No. 5,217,415 which has been found satisfactory for certain applications.

Seams can also be sewn on which involves a webbing sewn onto both cross-machine direction ("CD") ends of the dryer fabric. The webbing contains loops which are meshed together to form the seam. The webbing, since it is out of plane and thicker than the fabric body, also tends to bump around fabric support rolls, marks the sheet, and has zero permeability, which further exacerbates the sheet marking problem. Since it is sewn on, the stitching is between the web and the fabric body. Once the stitching fails, the web will pull off, resulting in a "seam failure".

Some fabrics have the aforesaid pin seams, however, with or without a spiral insert. These dominate the market today. All these seams require MD yarns to be woven back into the structure body by hand or machine assisted. CD yarns must be raveled out. Yarn materials, counts and sizes, weaves dictate the seam properties and the seam properties (uniformity, strength) dictate yarn counts within a certain weave. These seams are expensive to make, since they are labor intensive. The strength and seam durability are dictated by material properties too, especially loop strength. "Brittle" materials which have poor loop strength but may have other good properties are not dryer fabric candidates because of this. To compensate for low seam loop strength one may have to compromise on the fabric structure itself. An example of a seam having a spiral insert can be found in U.S. Pat. No. 5,915,422.

Early metal forming fabrics which were flat woven and shipped open ended, were installed on the machine with the metal wire ends joined together by brazing or fusing the yarns by heat. This "butt seam" had some slight end overlap and the seam only lasted for a short period of time. There was no sewing, stitching, or adding in a synthetic spiral.

Another example of a butt seam can be found in the aforementioned U.S. Pat. No. 5,360,656. This seam is between adjacent strips of fabric and includes stitching. The seams, however, are not load bearing and are merely there to hold the strips together so that the "base" structures formed by these joined together strips can be handled through the manufacturing process.

Obviously, there are other ways to provide seamable fabrics for use in papermaking and other industrial applications, with the foregoing being set forth merely as examples. However, as with anything, there is always a desire to improve on or provide an alternative to what has been done previously. Seamable fabrics are no exception. In this regard, heretofore providing a seam on a fabric has been relatively time consuming and labor intensive. If these are aspects that can be improved upon, this would obviously be a desirable result.

SUMMARY OF THE INVENTION

It is therefore a principal object of the invention to provide for a seamable papermaker's or industrial fabric wherein the seam is readily incorporated into the fabric.

It is a further object of the present invention to provide for such a fabric which allows the seam to be implemented in a cost-effective manner.

A yet further object of the present invention is to provide for such a seam which may be utilized on a variety of fabrics with different construction.

These and other objects and advantages are provided by the present invention. In this regard, the invention is directed towards providing a seam on a fabric, particularly a papermaker's or industrial fabric, which may be relatively easy to implement. It involves the use of preform loops or coils which are respectively attached to each end of the fabric to be joined in the cross-machine direction. The coils are sewn onto the end using a yarn or thread, which is sewn or looped around all or some of the respective bases of the loops of the coil and then sewn back onto the body of the fabric. Each coil base is preferably affixed with at least one, or preferably more, yarn or thread.

The stitching pattern can be zig-zag, chain, or lock pattern and may involve stitching lengths that vary to the extent in which they extend into the base fabric. Also, the angle of the stitch may vary along with the number of stitches attaching the base of the loops of each coil. The stitching may be further reinforced by stitching along the end of the fabric in the cross-machine direction and may comprise several rows thereof. The ends of the base fabric may also be further pre- and/or post-treated by compaction, pre-squeezing and sealing to stabilize the ends. Ultrasonic melting or fusing, pressing with or without heat, and chemical bonding such as adding a glue or resin may also be used. Note, however, that it is important to keep the seam area at least near to the air permeability of the fabric body. Also, such pre- and/or post-treatment can be used, not only to stabilize the ends, but also to reinforce and provide a smooth surface in the stitched area.

It has been found that the present invention reduces substantially the amount of time necessary to attach a seam to a fabric whilst providing for an effective seam.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENT

Figure 1:
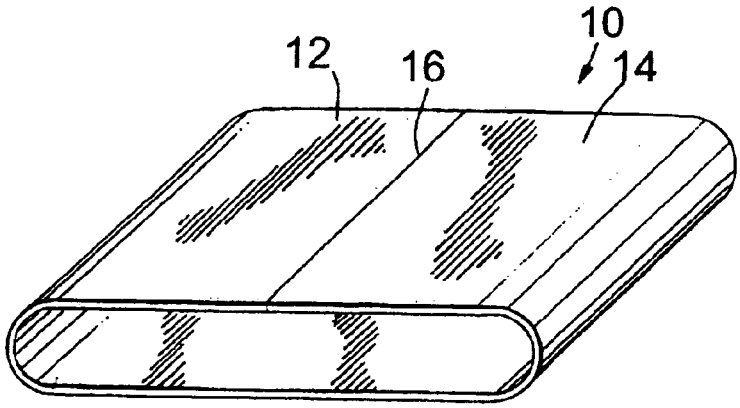
FIG. 1 is a schematic perspective view of a seamed fabric.

Turning now specifically to the figures, FIG. 1 is a schematic perspective view of the seamed papermaker's or industrial fabric 10. The fabric 10 takes the form of an endless loop once its two ends 12, 14 have been joined to one another at seam 16.

Figure 2:
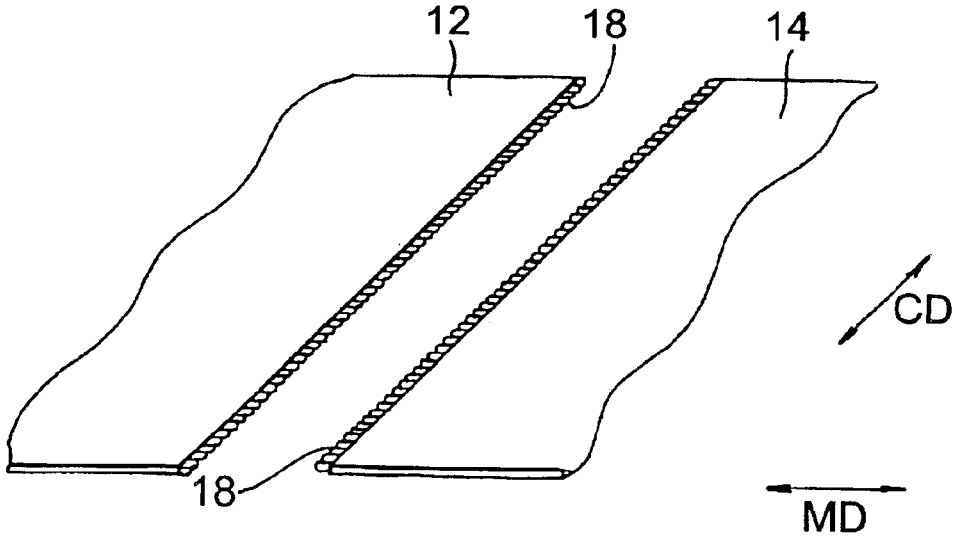
FIG. 2 is a schematic perspective view of the two ends of the fabric prior to their being joined to one another.

FIG. 2 is a schematic perspective view of the two ends 12, 14 of the fabric 10 prior to their attachment to one another. Widthwise across the ends of each of two ends 12, 14 are a plurality of loops 18. To attach the two ends 12, 14 to one another, they are brought together, in so doing alternating and intermeshing, or interdigitating, the seaming loops 18 at each end with one another. The interdigitated seaming loops 18 define a passage through which a pin, or pintle, a yarn-like strand or member, may be directed to secure the ends 12, 14 to one another by way of the "pin seam" so formed.

In the present invention, the seaming loops 18 are replaced by preformed loops or coils 20 which are attached to the ends 12, 14 of the fabric as will be discussed.

Figure 3:
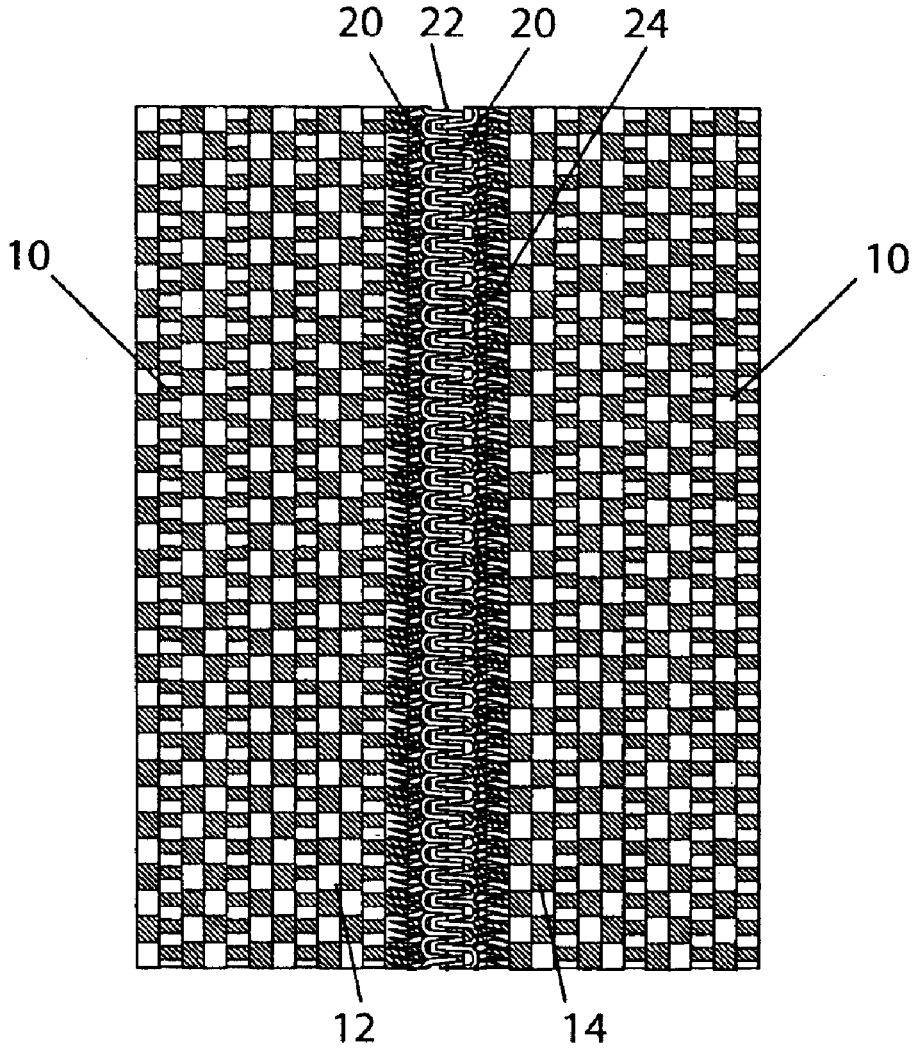
FIG. 3 is a top plan view of the seam, incorporating the teachings of the present invention.

As shown in FIG. 3, respective coils 20 are sewn onto the ends 12, 14 of the base fabric 10 with thread 24. The base fabric may be a woven fabric or a non-woven fabric. The coils 20 can be made of any material suitable for the purpose (e.g. polyester, polyamide, polyethelyne, Ryton, PEEK, metal, etc.). The coils do not need to be the same material. That is, the coil secured to fabric end 12 may be made from a material that is different from the material making up the coil secured to fabric end 14. In any event, after the coils 20 are affixed, the ends 12, 14 are brought together and the coils 20 intermeshed or interdigitated with each other so as to define a passage. A pin or pintle 22 is then inserted into the passage securing ends 12, 14 to each other.

In a preferred embodiment, the fabric ends 12 and 14 are even so that when they are butted together the fabric appears as endless weave fabric without any discontinuities at the seam or along its widthwise edges. The MD yarns of the respective edges do not have to match perfectly, although such matching is preferred.

The manner of affixing the coils 20 to ends 12, 14 will now be discussed. Initially, it may be desirable to stabilize the fabric at ends 12, 14. Depending upon the composition of the fabric, it may be desirable to compact or squeeze some portion of ends 12, 14 for the full width of the fabric to reduce the overall thickness of the fabric so that some, preferably most, if not all the stitching lies within the plane of the main fabric body thickness. This may involve treating this end area by ultrasonic melting, pressing with or without heat, or chemically bonding the MD and CD yams that make up the fabric ends 12, 14. Once this is done, the coils 20 are attached. In another embodiment, this preprocessing of the fabric ends may preferably be done after the coils are attached. In either case this involves sewing or stitching the respective coils 20 to each end 12, 14. A yarn or thread 24 is used which may be made of any material suitable for the purpose (e.g. industrial polyester, nylon, Nomex, Kevlar (aramids), Spectran (HMPE), Vectran (LCP) and TENARA and other polymers). The size of the thread 24 will depend upon the application and strength requirements. For example, #69 industrial polyester thread has superior strength to that of #45 (such as those manufactured by American and Efird, Inc and Saunders Thread Co. in what is commonly referred to as the TEX system of designation, the higher number indicates a larger diameter). Higher diameter thread may also be desirable. The yarns or thread used should be of a diameter of less than or equal to the diameter of the machine direction (MD) or cross-machine direction (CD) yarns at the ends 12, 14. This diameter can be of the yarn as new, as used, or after a compaction or pressing step as heretofore mentioned.

Figure 4A:
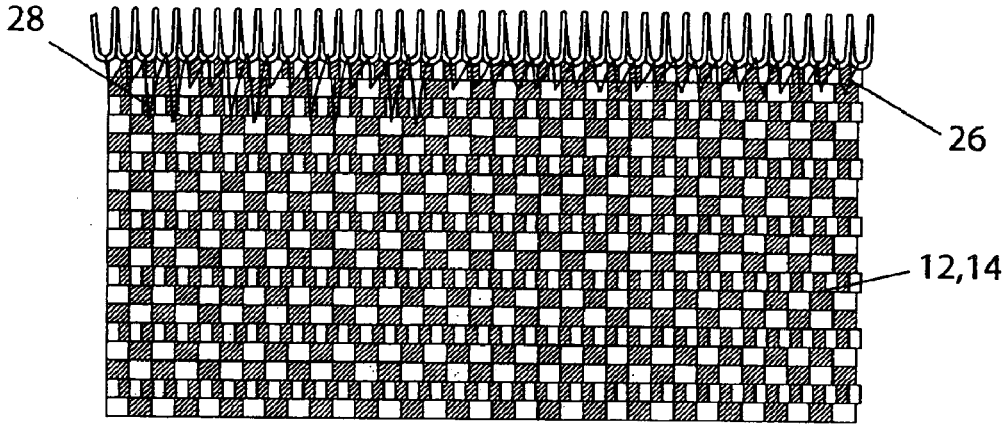
FIG. 4*a* is an enlarged plan view of the seam illustrating stitching patterns, incorporating the teachings of the present invention.

The pattern of the stitching used may take on various forms such as zig-zag, chain, or lock stitch patterns. As shown in FIG. 4*a*, the stitch illustrated is a zig-zag 26 or modified zig-zag 28 as will be discussed with regard to FIGS. 5*a* and 5*b*. The stitch spacing may be one or more (multiple catch) per base of the loops of the coil, i.e. double, triple or more.

The depth of the stitch in the fabric may also vary. Also, it may be desired to have a preliminary stitch to generally affix or align the coil 20 on ends 12, 14 and once aligned, implement a main stitching.

Also, once the stitching is completed, one or more rows of additional stitching parallel to ends 12, 14 or in the cross-machine direction (CD) and across the attachment stitching attaching the coil, might be used to reinforce the coil attachment. As much stitching that is required should be within the plane of the fabric thickness. There are multiple variations of what may be done.

As aforesaid, once the stitching is completed, the ends 12, 14 may be treated to otherwise stabilize the ends 12, 14 and reinforce and smooth the stitching thereon.

Figure 4B:
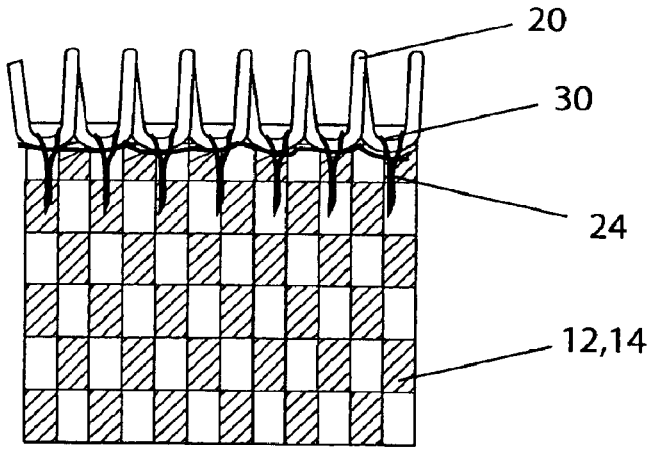
FIG. 4*b* is a detail view of one possible zig-zag stitching pattern as employed in a fabric end, incorporating the teachings of the present invention.

FIG. 4*b* shows in detail one possible zig-zag stitching pattern as employed in a fabric end according to the invention. In the figure, only one fabric end is illustrated, and it could be either of end 12 and end 14. As can be seen from the figure, thread 24 catches coil 20 at catching points 30.

Figure 5A:
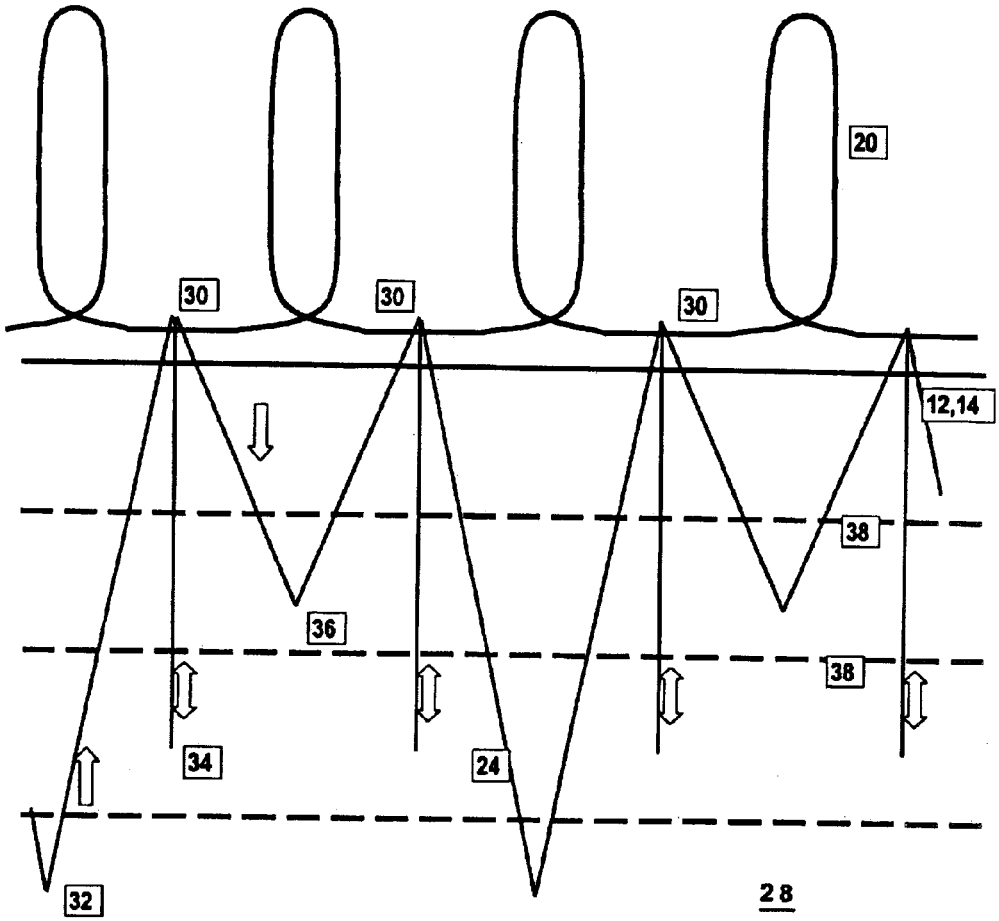
FIG. 5*a* shows a representative modified zig-zag stitching pattern which may be used to attach the coils, incorporating the teachings of the present invention.

Turning now generally to FIG. 5*a*, there is shown a stitch pattern, which is in the form of the modified zig-zag 28. The bases of the coil provide the catching points 30 for the thread 24. As can be seen in FIG. 5*a*, there are multiple catches of coil 20 at catching points 30. The thread 24 distance into the ends 12, 14 may vary from that terminating at point 32 to point 34 to point 36. The stitch may be a single stitch from point 32 to the catch point 30 looping around the base of coil 20 then to point 34, back to catch point 30 looping the base of coil 20 again and then continuing to point 36. This pattern could continue until the entire coil 20 is attached to ends 12, 14. The distance to points 32, 34, and 36 will depend upon the fabric structure (weave pattern, yarn sizes, yarn counts) of the fabric and the entire attachment system employed.

In addition, one or more rows of stitching 38 (zig-zag or otherwise) in the cross-machine direction, parallel to the ends 12, 14 and over thread 24 may be provided to further reinforce thread 24.

Figure 5B:
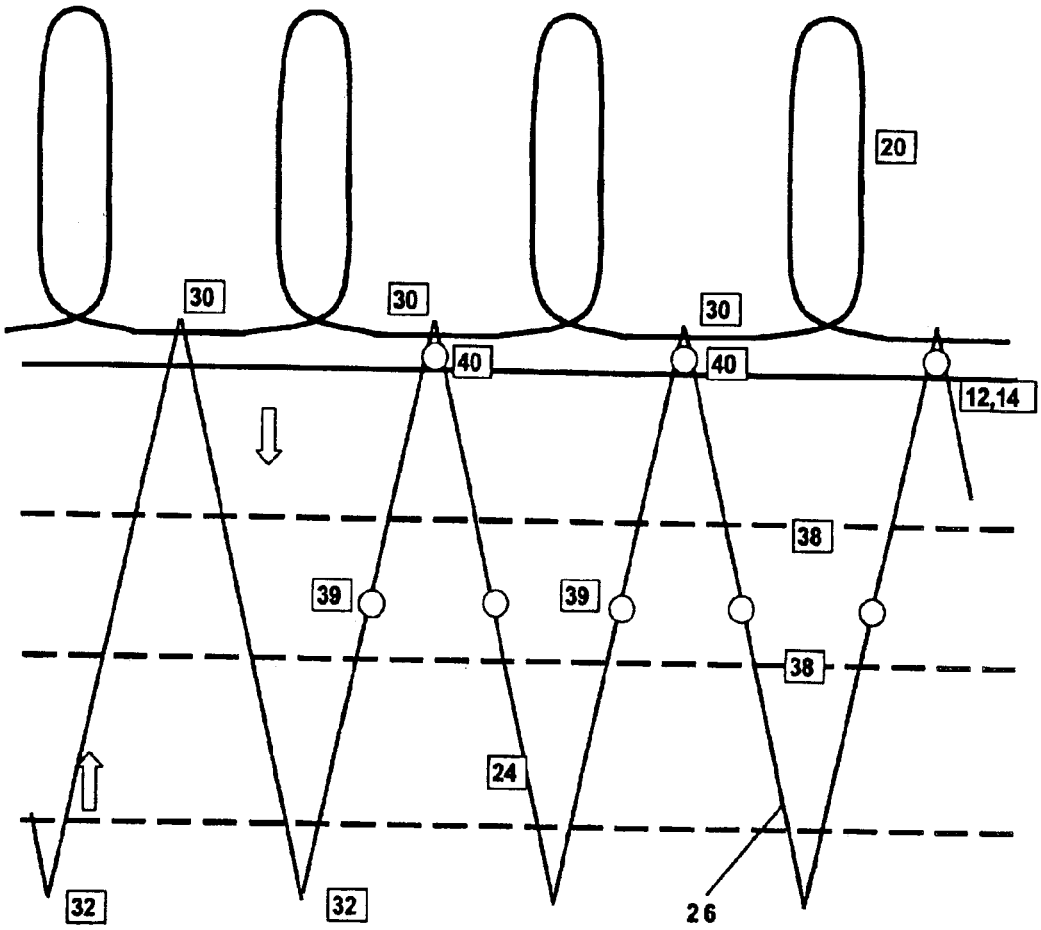
FIG. 5*b* shows a representative zig-zag stitching pattern which may be used to attach the coils, incorporating the teachings of the present invention.

Turning now generally to FIG. 5*b*, there is shown a stitch pattern, which is in the form of the zig-zag 26. As was the case with the modified zig-zag 28 of FIG. 5*a*, the bases of the coil provide the catching points 30 for the thread 24. However, in the illustrated zig-zag 26 of FIG. 5*b*, there is only one catch of coil 20 at each catching point 30. The thread 24 distance into the ends 12, 14 is determined according to terminating points 32 and the distance may be the same for each terminating point or it may vary from terminating point to terminating point. Generally, the stitch is a single stitch from a terminating point 32 to the catch point 30 looping around the base of coil 20 and then to the next terminating point 32. This pattern could continue until the entire coil 20 is attached to ends 12, 14. The distance to points 32 will depend upon the fabric structure (weave pattern, yarn sizes, yarn counts) of the fabric and the entire attachment system employed.

A feature of the stitch pattern of FIG. 5*b* is that each base of the coil is caught once for each zig-zag or direction change. Another feature is that the thread 24 may stitch or interlock more than once for each zig-zag, at points 39 and again at points 40.

In addition, one or more rows of stitching 38 (zig-zag or otherwise) in the cross-machine direction, parallel to the ends 12, 14 and over thread 24 may be provided to further reinforce thread 24.

It should be noted that, in any case, the final overall seam geometry need not be a line running perpendicular to the direction of the MD yarns (as shown, for example, in FIG. 1). The overall seam geometry may take on many alternative shapes. For instance, the seam may run in a direction that is diagonal to the MD yams, in a "V" pattern, "inverted V" pattern or saw tooth pattern.

It should be further noted that a primary advantage of the present invention is that the structure of the papermaking or industrial fabric (e.g. yarns, yarn counts, yam dimensions and weaver) is no longer restricted by the needs of the seam. That is, since there is no "fold back" and reweaving of MD yarns to form a pin seam, or to pin-in a coil, one can melt/cut "indents" into the fabric body, allowing the coils to nest into the fabric body, and then stitch the coils in place.

Although a preferred embodiment has been disclosed and described in detail herein, its scope should not be limited thereby; rather its scope should be determined by that of the appended claims.

What is claimed is:

1. A papermaking or other industrial fabric formed from a base fabric and having a seam where a first end of said base fabric is attached to a second end of said base fabric, wherein at least one preformed coil is attached to said first end or to said second end, and said coil being affixed to said first end or second end by stitching as between said fabric and said coil; and at least one thread stitched in a modified zig-zag, chain, or lock stitch pattern.

2. A papermaking or other industrial fabric as set forth in claim 1, wherein two preformed coils are used to attach said first end to said second end.

3. A papermaking or other industrial fabric as set forth in claim 2, further comprising thread placed along the direction of said seam and within both of said preformed coils, said thread and said preformed coils being used to attach said first end to said second end.

4. A papermaking or other industrial fabric formed from a base fabric and having a seam where a first end of said base fabric is attached to a second end of said base fabric, wherein at least one preformed coil is attached to said first end or to said second end, and said coil being affixed to said first end or second end by stitching as between said fabric and said coil; and further comprising at least one thread stitched in a zig-zag pattern to help secure said preformed coil to at least one of said first end or said second end; and one or more rows of additional stitching parallel to the said first end and said second end or in the cross-machine direction, and across the stitching affixing said coil.

5. A papermaking or other industrial fabric as set forth in claim 1, wherein the at least one thread stitched in said modified zig-zag pattern helps secure said preformed coil to at least one of said first end or said second end.

6. A method for forming a papermaking or other industrial fabric, comprising the steps of:

providing a preformed coil and a base fabric having two ends;

stitching said preformed coil to at least one end of said fabric;

attaching a first end of said base fabric to a second end of said base fabric using said preformed coil, thereby forming a seam; and stitching at least one thread in a modified zig-zag, chain, or lock stitch pattern.

7. A method for forming a papermaking or other industrial fabric as set forth in claim 6, wherein two preformed coils are used to attach said first end to said second end.

8. A method for forming a papermaking or other industrial fabric as set forth in claim 7, further comprising the step of placing a thread along the direction of said seam and within both of said preformed coils, said thread and said preformed coils being used to attach said first end to said second end.

9. A method for forming a papermaking or other industrial fabric comprising the steps of:

providing a preformed coil and a base fabric having two ends;

stitching said preformed coil to at least one end of said fabric;

attaching a first end of said base fabric to a second end of said base fabric using said preformed coil, thereby forming a seam;

stitching at least one thread in a zig-zag pattern to help secure said preformed coil to at least one of said first end and said second end; and stitching one or more rows of additional stitching parallel to the said first end and said second end or in the cross-machine direction, and across the stitching affixing said coil.

10. A method for forming a papermaking or other industrial fabric as set forth in claim 6, wherein the step of stitching the at least one thread in said modified zig-zag pattern helps secure said preformed coil to at least one of said first end or said second end.

11. A method for forming a papermaking or other industrial fabric as set forth in claim 6, wherein the step of stitching the at least one yarn in said modified zig-zag pattern helps secure said preformed coil to at least one of said first end or said second end.

12. A papermaking or other industrial fabric formed by providing a preformed coil and a base fabric, and attaching a first end of said base fabric to a second end of said base fabric using said preformed coil, wherein said coil is affixed to said first end or second end by stitching as between said fabric and said coil thereby forming a seam; and said fabric further comprises at least one thread stitched in a modified zig-zag, chain, or lock stitch pattern.

13. A papermaking or other industrial fabric as set forth in claim 12, wherein two preformed coils are used to attach said first end to said second end.

14. A papermaking or other industrial fabric as set forth in claim 13, further comprising a thread placed along the direction of said seam and within both of said preformed coils, said thread and said preformed coils being used to attach said first end to said second end.

15. A papermaking or other industrial fabric formed by providing a preformed coil and a base fabric, and attaching a first end of said base fabric to a second end of said base fabric using said preformed coil, wherein said coil is affixed to said first end or second end by stitching as between said fabric and said coil thereby forming a seam and said fabric further comprising at least one thread stitched in a zig-zag pattern to help secure said preformed coil to at least one of said first end or said second end; and one or more rows of additional stitching parallel to the said first end and said second end or in the cross-machine direction, and across the stitching affixing said coil.

16. A papermaking or other industrial fabric as set forth in claim 12, wherein the at least one thread stitched in said modified zig-zag pattern helps secure said preformed coil to at least one of said first end or said second end.

17. A papermaking or other industrial fabric formed from a base fabric and having a seam where a first end of said base fabric is attached to a second end of said base fabric, wherein at least one preformed coil is attached to said first end or to said second end, and said coil being affixed to said first end or second end by stitching as between said fabric and said coil wherein said fabric includes a machine direction and a cross machine direction and the seam is attached to said first end or said second in a manner selected from the group consisting essentially of:

transverse to the machine direction; diagonal to the machine direction; a "V" pattern with respect to the machine direction; an inverted "V" pattern with respect to the machine direction; and a saw tooth pattern with respect to the machine direction.

18. A method of forming a papermakers or other industrial fabric comprising the steps of:

providing a preformed coil and a base fabric having two ends;

stitching said preformed coil to at least one end of said fabric; and attaching a first end of said base fabric to a second end of said base fabric using said preformed coil, thereby forming a seam wherein said fabric includes a machine direction and a cross machine direction and the seam is attached to said first end or said second in a manner selected from the group consisting essentially of:

transverse to the machine direction; diagonal to the machine direction; a "V" pattern with respect to the machine direction; an inverted "V" pattern with respect to the machine direction; and a saw tooth pattern with respect to the machine direction.

19. A papermaking or other industrial fabric formed by providing a preformed coil and a base fabric, and attaching a first end of said base fabric to a second end of said base fabric using said preformed coil, wherein said coil is affixed to said first end or second end by stitching as between said fabric and said coil thereby forming a seam wherein said fabric includes a machine direction and a cross machine direction and the seam is attached to said first end or said second in a manner selected from the group consisting essentially of:

transverse to the machine direction; diagonal to the machine direction; a "V" pattern with respect to the machine direction; an inverted "V" pattern with respect to the machine direction; and a saw tooth pattern with respect to the machine direction.

20. A papermaking or other industrial fabric as set forth in claim 1, further comprising one or more rows of additional stitching parallel to the said first end and said second end or in the cross-machine direction, and across the stitching affixing said coil.

21. A method for forming a papermaking or other industrial fabric as set forth in claim 6, further comprising the step of:

stitching one or more rows of additional stitching parallel to the said first end and said second end or in the cross-machine direction, and across the stitching affixing said coil.

22. A papermaking or other industrial fabric as set forth in claim 12, further comprising one or more rows of additional stitching parallel to the said first end and said second end or in the cross-machine direction, and across the stitching affixing said coil.

* * * * *